US005649739A

United States Patent [19]

Zapf

[11] Patent Number: 5,649,739

[45] Date of Patent: Jul. 22, 1997

[54] BACKREST FOR A SEAT ARRANGEMENT

[76] Inventor: Otto W. Zapf, Herzog-Adolph-Strasse 5, D-61462, Konigstein, Germany

[21] Appl. No.: 660,661

[22] Filed: Jun. 4, 1996

Related U.S. Application Data

[63] Continuation-in-part of Ser. No. 304,280, Sep. 12, 1994, abandoned.

[30] Foreign Application Priority Data

Sep. 13, 1993 [DE] Germany ..... 9313841 U
Aug. 8, 1995 [DE] Germany ..... 295 12 726.6

[51] Int. Cl.[6] ..... A47C 3/00; B60N 2/02

[52] U.S. Cl. ..... 297/301.1; 297/299; 297/452.31; 297/354.11; 297/284.4

[58] Field of Search ..... 297/301.3, 296, 297/297, 283, 299, 284.1, 452.31, 452.29, 354.1, 354.11, 354.12, 301.1, 301.4, 284.4

[56] References Cited

U.S. PATENT DOCUMENTS 4,007,962 2/1977 Müller-Deisig ..... 297/301.1
4,316,632 2/1982 Brauning ..... 297/301.1
4,799,732 1/1989 Yamazaki ..... 297/301
4,830,430 5/1989 Schäfer ..... 297/301.1

FOREIGN PATENT DOCUMENTS 3025916 1/1982 Germany ..... 297/354.12
3030218 4/1982 Germany ..... 297/354.12

*Primary Examiner*—Peter M. Cuomo
*Assistant Examiner*—Anthony D. Barfield
*Attorney, Agent, or Firm*—Kirschstein, et al.

[57] ABSTRACT

A backrest for a seat includes an upper back portion having an integral, central extension, a lower back portion having a central cut-out, and hinges for pivotally connecting the upper and lower back portions together to permit free swinging movement of the extension through the cut-out about a pivot axis situated at a level above the extension so that substantially the entire extension can come out of the cut-out in a reclined position of the upper back portion to support the lower back of the seat occupant. The extension may be provided with a central recess separating two lateral prongs from one another, and an elastic band may then be used to span the recess between the prongs.

20 Claims, 5 Drawing Sheets

BACKREST FOR A SEAT ARRANGEMENT

CROSS-REFERENCE TO RELATED APPLICATIONS

This application is a continuation-in-part application of my earlier U.S. patent application Ser. No. 08/304,280, filed on Sep. 12, 1994, and now abandoned.

BACKGROUND OF THE INVENTION

1. Field of the Invention

This invention relates to a backrest for a seat in general, and more particularly to a seat backrest constructed to resiliently yield in substantial conformity with the body contour of an occupant of the seat.

2. Description of the Related Art

Many different seat backrests have been proposed in the art for increasing the comfort of a seated occupant. As shown, for example, in German Patent DE-41 37 488.6, the backrest may have a movable part that engages a lower region of the back of the occupant, thereby helping to alleviate back discomfort during long seating. Although generally satisfactory for its intended purpose, experience has shown that the known backrests with movable parts are subject to material fatigue and breakage over time, thereby rendering them unusable.

On the other hand, there is also known, from the U.S. Pat. No. 4,799,732 to Yamazaki, a chair seat inclining and moving device in which the backrest proper is subdivided into two parts one of which includes two side portions delimiting a recess between themselves, while the other has a projection substantially conformingly projecting into the recess in an initial or rest position of the backrest. The two parts are connected to one another for pivoting and acted upon by respective springs urging the movable part towards its rest position when the seat is not occupied.

However, when an occupant sits down on the seat and reclines back ever so slightly in contact with the backrest, the forces exerted by his or her back on the backrest cause the movable part to pivot relative to the other part, offering resilient resistance in the process, which is supposed to be perceived as comfort. Yet, the solution presented in this patent is based on the erroneous premise that the magnitude of the step that comes into being between the stationary and movable parts as the latter is being pushed back needs to be kept to a minimum; as a consequence, the pivoting axis bisects the recess and the projecting portion extending into it about half-way down. That, of course, means that the step will be situated somewhere at the mid-back region of the user, i.e. at a location at which it will be perceived as an unwelcome disturbance, no matter how small it may be, thus defeating the very purpose of this patent.

To complete the picture, it is also to be pointed out that German patent 38 26 290.8-09 also discloses a backrest of a sitting piece of furniture, wherein either the central upper region of the upper backrest part and the central lower region of the lower backrest part exhibit greater elasticity than the remaining regions of the backrest, or both of these regions are rearwardly buckled. In this respect, it is to be mentioned that the increased elasticity of these two regions was achieved there by making the upper portion and the lower portion of bifurcated configurations, and by training respective stretched elastic belts around the prongs of such bifurcated portions so as to extend between the such portions.

SUMMARY OF THE INVENTION

Objects of the Invention

It is a general object of this invention to advance the state of the art of seat backrests.

Another object of this invention is to provide a comfortable backrest.

An additional object of this invention is to provide a durable backrest.

Features of the Invention

In keeping with these objects and others which will become apparent hereinafter, one feature of this invention resides, briefly stated, in a backrest for a seat. As considered in its position of use, the backrest includes a lower stationary back portion having a pair of side parts with upper edges, and a central cut-out depending from the upper edges between the side parts; an upper movable back portion having a pair of side sections with lower edges, and an integral central extension depending from the lower edges between the side sections; and means at and extending across respective interspaces existing between the upper and lower edges at an elevation above the extension for connecting the side sections of the upper back portion and the side parts of the lower back portion with one another for pivoting of the movable upper back portion relative to the stationary lower back portion about a pivot axis extending transversely above the extension from a first position in which the extension is fully received within the cut-out to a second position in which the extension is located substantially entirely outside the cut-out and frontwardly of the lower back portion in a supporting relationship with the lower back of an occupant sitting on the seat.

In a currently preferred embodiment, the upper back portion extends along the pivot axis between opposite side sections, and the extension extends transversely of the pivot axis between the side sections. Also, the lower back portion extends along the pivot axis between opposite side parts, and the cut-out extends transversely of the pivot axis between the side parts. The connecting means advantageously includes a pair of hinges spaced apart along the pivot axis. The hinges are mounted on the side sections of the upper back portion and the side parts of the lower back portion.

The upper and lower back portions have front and rear surfaces respectively facing towards and away from a seated occupant. The connecting means includes biasing means for constantly urging the upper and lower back portions to an untensioned position in which the extension is fully received in the cut-out.

In accordance with a first embodiment, the biasing means is an elastic plate. This plate is mounted to the rear surfaces of the upper and lower back portions. In a second embodiment, the elastic plate is mounted between the front and rear surfaces of the upper and lower back portions. In accordance with another embodiment of this invention, the biasing means is an elastic block which is cast between the front and rear surfaces of the upper and lower back portions. In all of the disclosed embodiments, the hinges are located either flush with the front surfaces of the upper and lower back portions, or rearwardly of the front surfaces, thereby ensuring that no part of the hinges extends forwardly of the front surfaces.

The preferred commercial embodiment forms the upper and lower back portions of a sheet material, e.g., plywood. The cut-out is formed with a shape which has a complementary contour to the shape of the extension. The upper and lower back portions and the hinges are assembled of a one-piece construction. The lower back portion preferably includes an integral seat portion. Pads are mounted on the upper and lower back portions, as well as the seat portion, for increased user comfort.

In accordance with a further aspect of the present invention, the extension has a bifurcated configuration containing a recess situated between two transversely spaced prongs. Then, there is further provided at least one elastic band trained around the prongs and extending in a stretched condition across the recess between the prongs. It is particularly advantageous in this context when the cut-out and the extension have transverse widths exceeding one-half the width of the lower back portion.

An additional advantageous facet of the present invention can be found in the fact that even the upper region of the upper back portion is constructed in such a manner as to increase the feeling of comfort on the part of the seat occupant. This is accomplished in accordance with the present invention either by giving the upper back portion a rearwardly buckled configuration at its upper central region, or by bifurcating the upper region of the upper back portion as well to provide upwardly pointing prongs at that location, and by using at least one additional elastic band at that location, this band being trained around the upwardly pointing prongs and extending in a stretched condition across an additional recess situated between the upwardly pointing prongs.

Last but not least, it is advantageous at least in some circumstances for the upper portion of the backrest to have such a configuration that the extension and the remainder of the upper back part enclose with one another an angle deviating to a small but significant degree from 180°.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
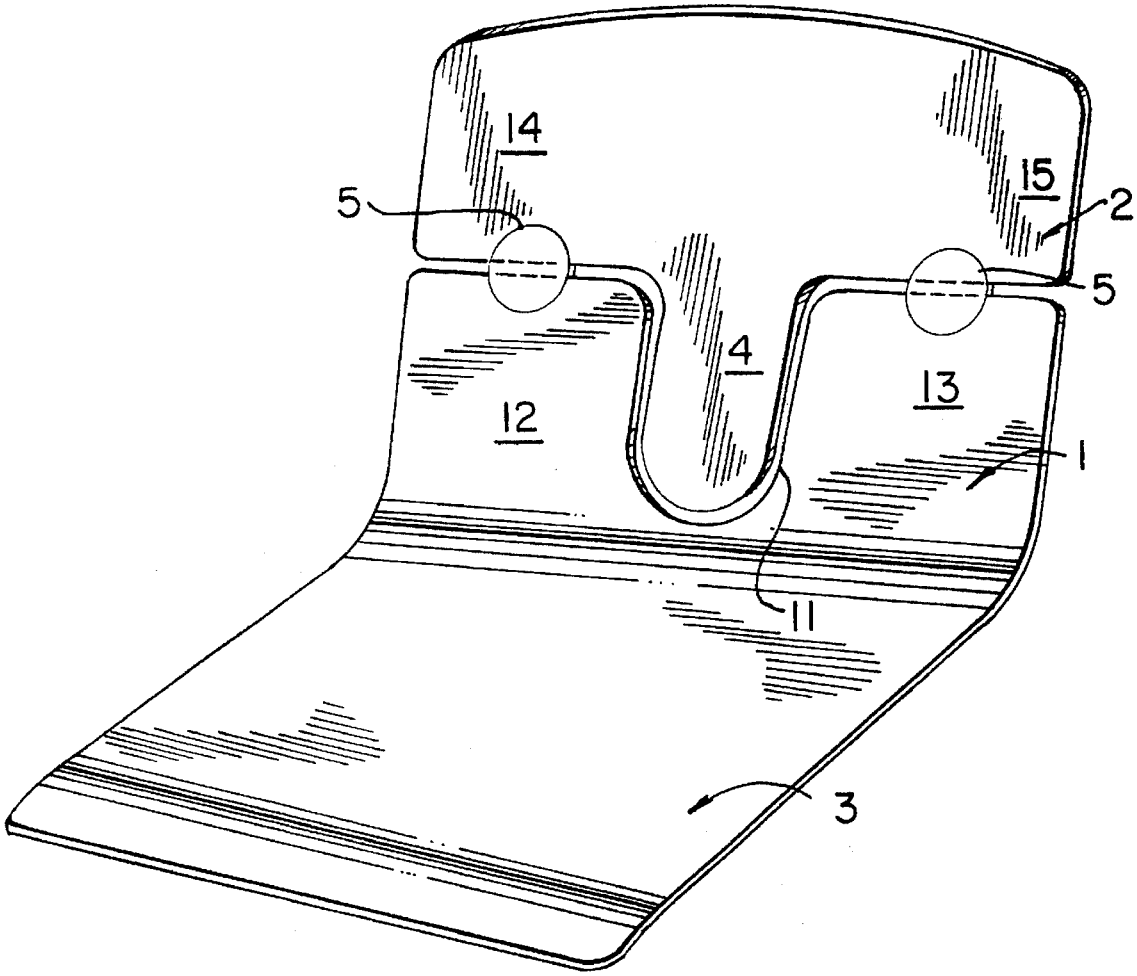
FIG. 1 is a perspective view of a backrest for a seat in accordance with this invention.

Referring now to the drawing, and first to FIG. 1 thereof, it may be seen that it shows a backrest for a seat or a chair. The backrest includes a lower sheet-like back portion 1 having a generally U-shaped, central cut-out 11 bounded at opposite sides by respective side parts 12, 13. The backrest also includes an upper sheet-like back portion 2 having an integral, central, generally U-shaped projection or extension 4 bounded at opposite sides by respective side sections 14, 15.

As also shown in FIG. 1, the side sections 14 and 15 are generally co-planar with the side parts 12, 13 when the lower and upper portions assume their relative position illustrated there. The extension 4 is then fully contained within the cut-out 11. Thus, the side parts 12, 13 and the side sections 14, 15 form a smooth, generally continuous surface for engaging the back of a seated occupant. The backrest may further include a sheet-like seat part 3 integral with the lower back portion 1, and extending generally perpendicularly to the side parts 12, 13.

The reference numerals 5 generally denote in FIG. 1 and elsewhere respective connecting arrangements that pivotally connect the upper and lower back portions 2 and 1. Examples of hinges or analogous connectors suitable for this purpose are shown in FIGS. 2 through 6.

Figure 2:
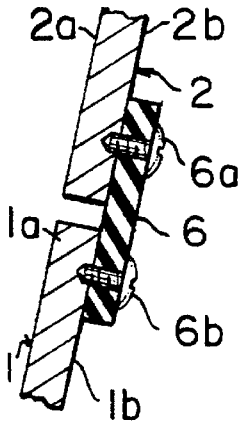
FIG. 2 is a sectional view of a first embodiment of a hinge for use with the backrest of FIG. 1.

Thus, as shown in FIG. 2, the lower and upper back portions 1 and 2 have front surfaces 1*a* and 2*a*, as well as rear surfaces 1*b* and 2*b*, respectively, facing towards and away from a seated occupant when the seat 4 and the associated backrest 1, 2 are being used for this purpose. A flexible, elastic plate 6 constitutes the hinge or connecting arrangement 5, It is advantageously made of rubber, resilient synthetic plastic material, or analogous elastic material. The plate 6 is mounted to the rear surfaces 1*b*, 2*b*, preferably with the aid of threaded fasteners 6*a*, 6*b*.

Figure 3:
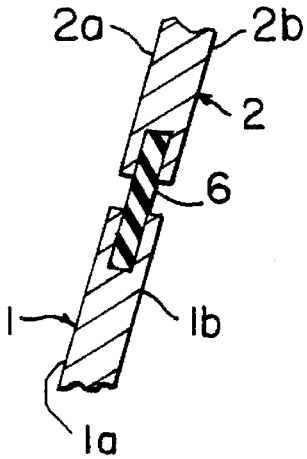
FIG. 3 is a sectional view of a second embodiment of a hinge for use with the backrest of FIG. 1.

As shown in FIG. 3, the aforementioned elastic plate 6 is now mounted essentially between the front surfaces 1*a*, 2*a* and the rear surfaces 1*b*, 2*b*. Slits are formed in the peripheral edges of the lower and upper back portions 1 and 2. The mutually opposite ends of the plate 6 are mounted in these slits.

Figure 4:
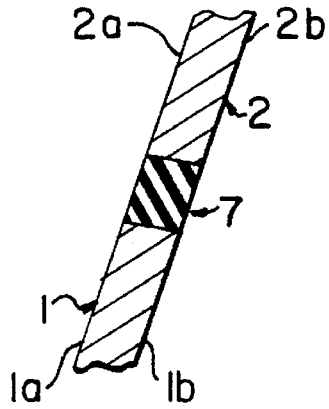
FIG. 4 is a sectional view of a third embodiment of a hinge for use with the backrest of FIG. 1.

FIG. 4 shows an elastic block 7 cast of one piece with the upper and lower back portions 1 and 2. The block 7 fills the entire space between the front surfaces 1*a*, 2*a* and the back surfaces 1*b*, 2*b* of the lower and upper back portions 1 and 2.

Figure 5:
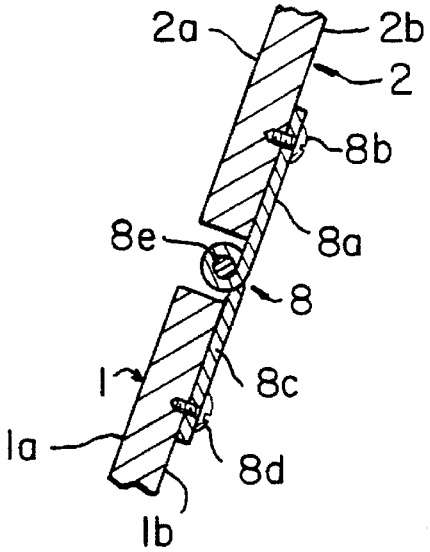
FIG. 5 is a sectional view of a fourth embodiment of a hinge for use with the backrest of FIG. 1.

FIG. 5 depicts a mechanical hinge 8 having a first hinge plate 8*a* mounted on the rear surface 2*b* with the aid of a threaded fastener 8*b*, and a second hinge plate 8*c* mounted on the rear surface 1*b* with the aid of a threaded fastener 8*d*. A hinge pin 8*e* extends through journals provided respectively on the two hinge plates 8*a*, 8*c*.

Figure 6:
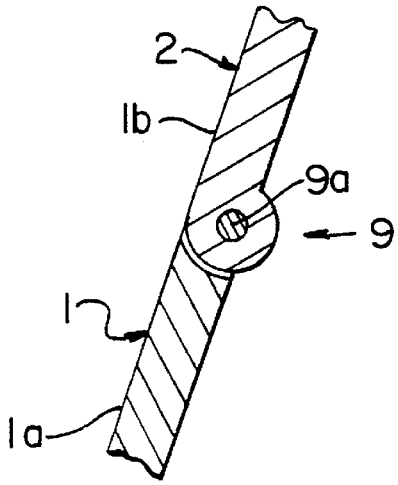
FIG. 6 is a sectional view of a fifth embodiment of a hinge for use with the backrest of FIG. 1.

FIG. 6 depicts a hinge 9 formed integrally with the lower and upper portions 1 and 2. Thus, the upper and lower back portions 1, 2 are integrally molded with journals through which a hinge pin 9*a* is inserted.

In all of the various hinge constructions depicted in FIGS. 2–6, it will be noted that no part of any hinge projects forwardly of the front surfaces 1*a*, 2*a*, thereby ensuring that the back of the seated occupant is presented with a smooth outer surface against which to rest. If the occupant exerts pressure against the upper back portion 2, then the upper back portion 2 will pivot at the hinges. The extension 4 is free to swing through the cut-out 11 and into supporting engagement with the lower back of the seated occupant, thereby providing additional support thereto. Once the occupant releases this pressure against the upper back portion 2, then the resilient hinges or connecting arrangements 5, whatever their particular structures, act to constantly urge and return the upper and lower back portions 1, 2 to their original relative positions shown in FIG. 1.

Figure 7:
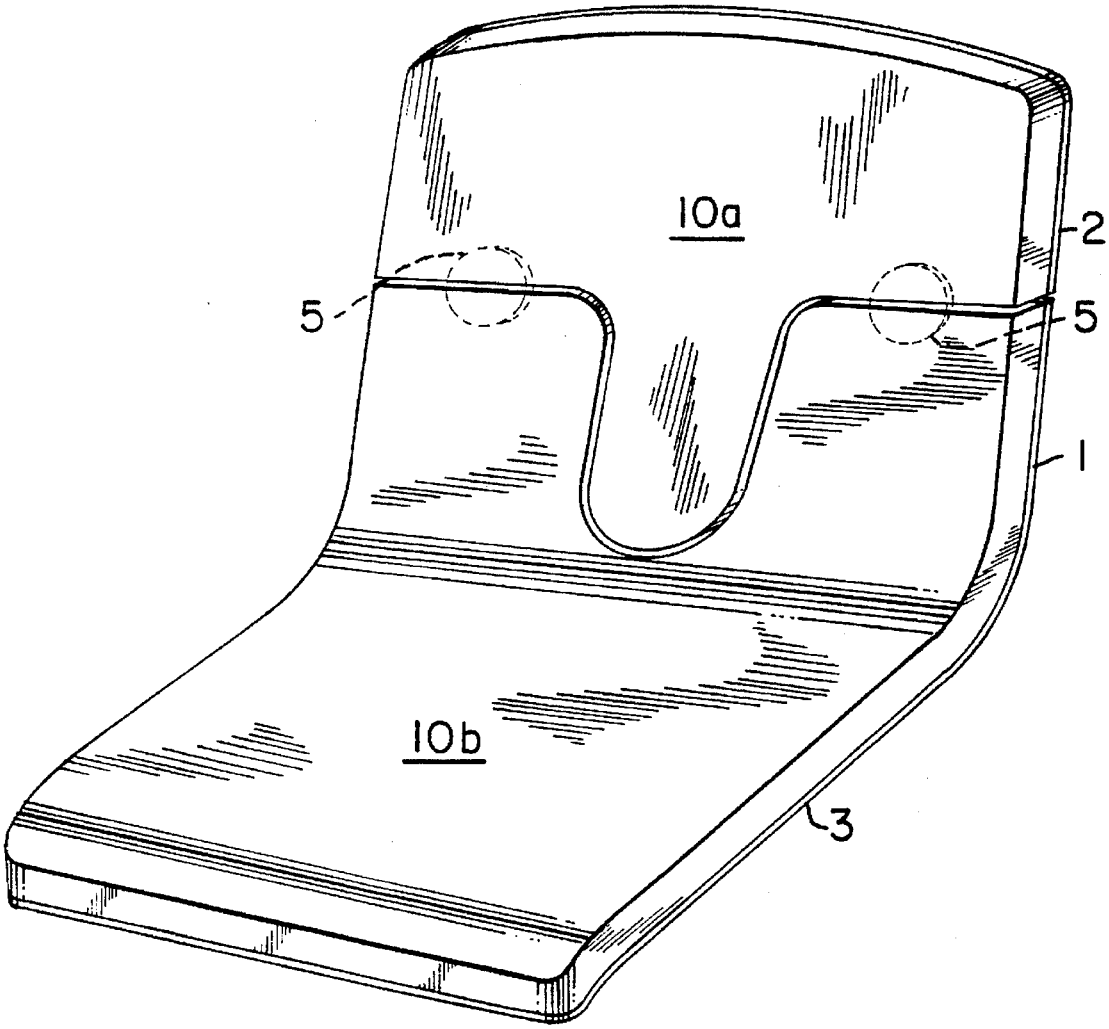
FIG. 7 is a perspective view of a padded backrest for a seat in accordance with this invention.

FIG. 7 is analogous to FIG. 1, and additionally shows pads 10*a*, 10*b* upholstered on the upper and lower back portions 1 and 2, respectively. When such pads are used, it is not necessary to position the hinge arrangement 5 flush with or behind the front surfaces 1*a*, 2*a* of the lower and upper back portions. Thus, as shown for a representative hinge 6 akin to that of FIG. 2, the hinge 6 may be mounted on the front surfaces 1*a*, 2*a* in the embodiment of FIG. 8.

Figure 8:
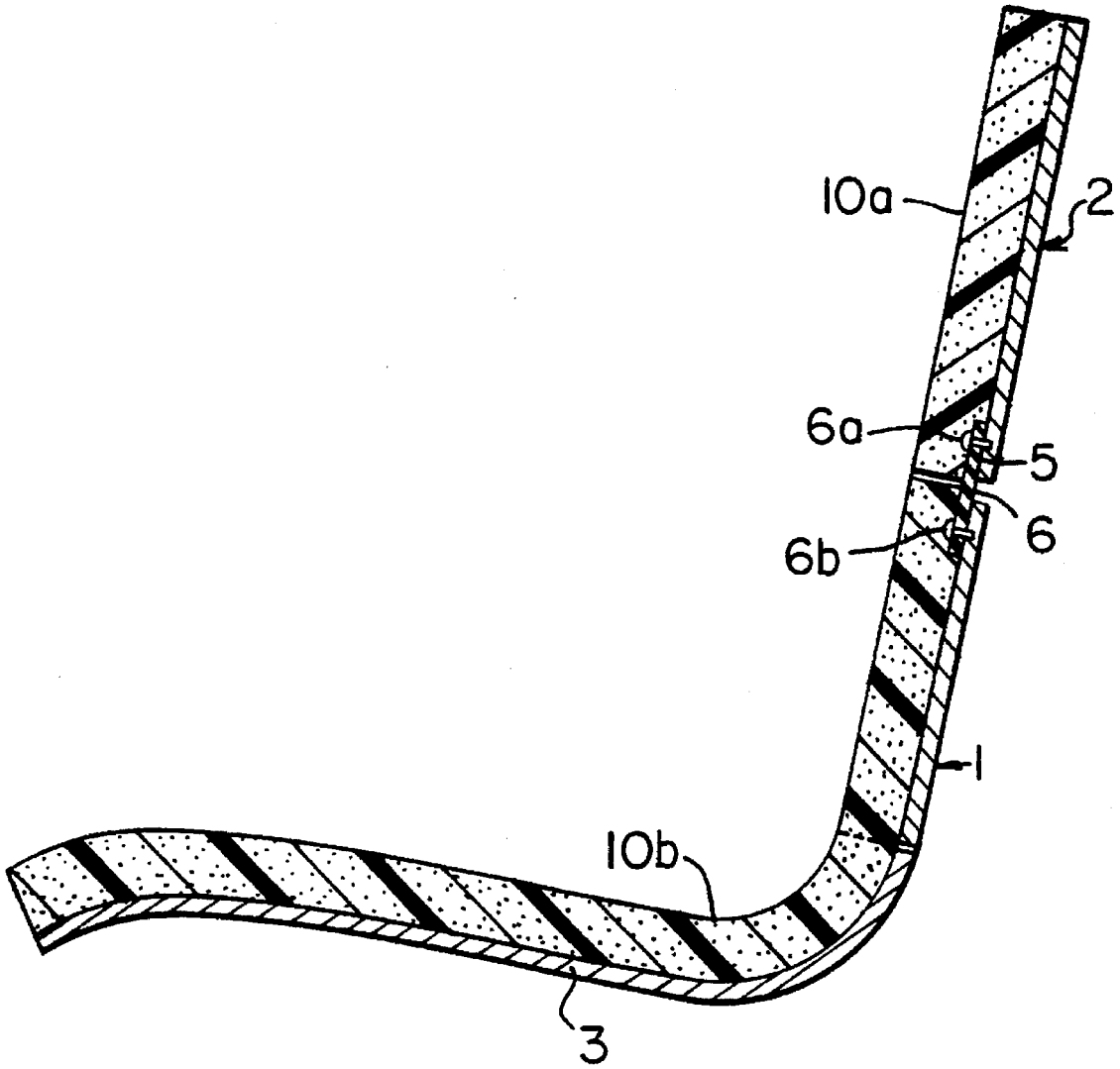
FIG. 8 is a sectional view of the padded backrest of FIG. 7.

As shown, the side parts 12, 13 and the side sections 14, 15 generally lie in a common plane, i.e., the side parts 12, 13 lie at a straight angle relative to the side sections 14, 15. In use, the upper back portion 2 pivots in either circumferential direction about the pivot axis relative to the lower back portion 1. Hence, the side parts 12, 13 may lie at an acute angle or at an obtuse angle relative to the side sections 13, 14. This movement in either sense is rendered possible, among others, by the presence of a relatively wide gap between the backrest portions 1 and 2, as depicted in FIG. 8.

However, it is also contemplated by the present invention, even though it is not specifically shown in the drawing, to configure the respective mutually facing upper and lower edge surfaces, respectively, of the lower and upper backrest portions 1 and 2 as to define a gap of a basically V-shaped configuration between themselves, with the V diverging in the rearward direction. In that case, there occasionally or even regularly comes a time when the upper backrest portion 2 has been inclined sufficiently in the rearward direction for the two facing edge surfaces to come into abutment with one another and, as a consequence, for any further movement of the backrest in the rearward direction to be terminated. Even this stop-motion action is considered by many users to be an attribute that contributes to their feeling of safety and reliability and hence comfort.

Figure 9:
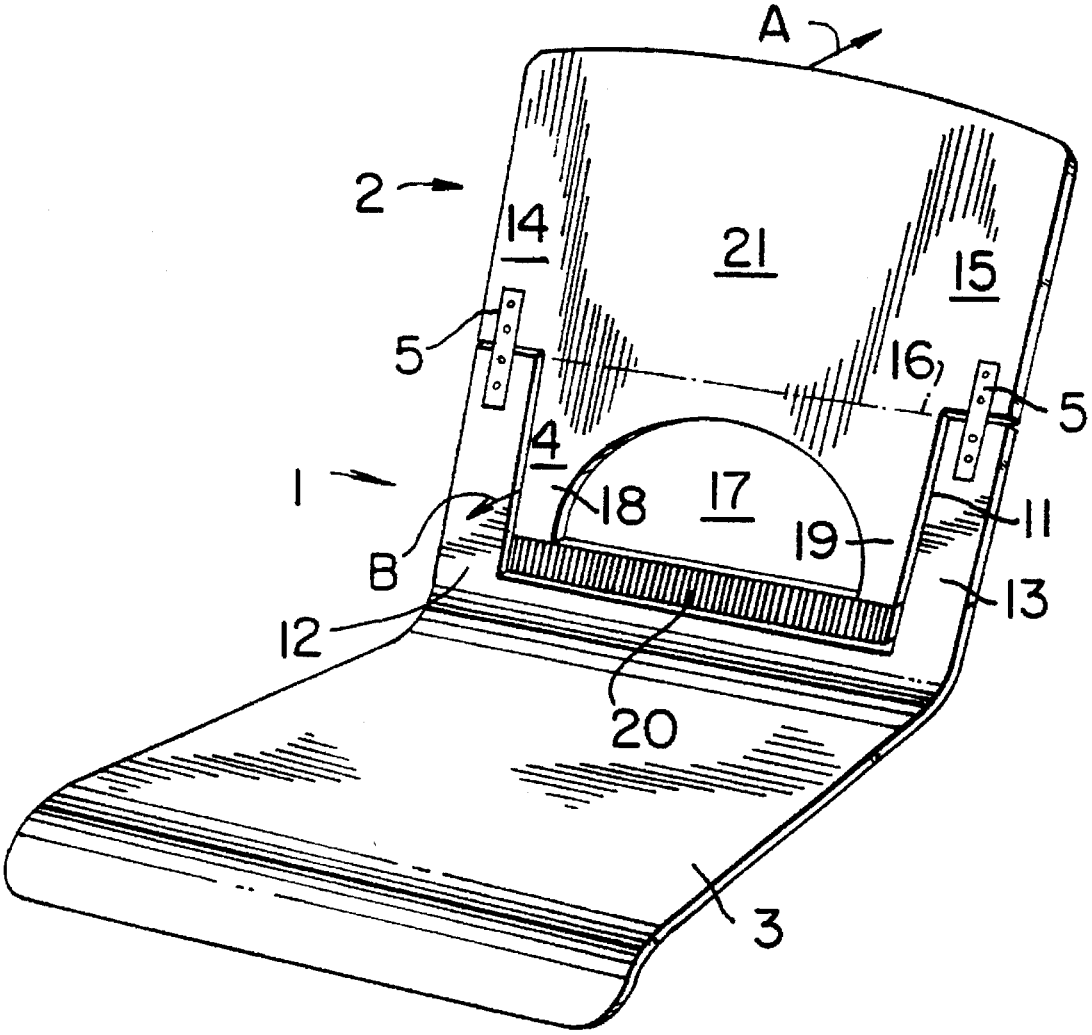
FIG. 9 is a perspective view of a modified construction of a backrest of the present invention.

Turning now to FIG. 9 of the drawing, it may be observed there that the same reference numerals as before have been used therein to designate corresponding parts. Here again, the backrest is composed of a lower portion 1 and an upper portion 2. The two portions 1 and 2 are again connected by respective connecting or hinge arrangements 5, in such a manner that the backrest portions 1 and 2 can be pivoted relative to one another. In addition thereto, it is indicated in FIG. 9 that the upper and lower parts 1, 2 of the backrest are caused to include with one another an angle that deviates to a relatively small yet perceptually significant degree from 180°, in such a manner that this angle is obtuse as viewed from the front of the backrest 1, 2. A crease line indicative of the existence of this angle on the upper backrest portion 2 is designated by the reference numeral 16.

In this instance, the cut-out 11 and the extension 4 are much wider than what is shown in FIG. 1; as a matter of fact, they occupy a predominant part of the width of the backrest 1, 2 at the regions at which they are situated, leaving only relatively narrow strips (the side parts 12, 13) on their two sides. As a matter of fact, it is currently preferred in this instance for the width of the cut-out 11 and the corresponding extension 4 to exceed one-half of the width of the backrest 1, 2 at the elevation at which they are provided. Then, a recess 17 is provided in the extension 4, making it bifurcated, that is defining respective lateral prongs 18 and 19 therein. The recess 17 is shown to have an outline of a substantially circular, oval, or elliptical cylinder, but this particular shape, as advantageous as it is, could be replaced, e.g., by one exhibiting a rectangular outline. What is important is that the recess 17 forms the prongs 18 and 19, and that it constitutes an empty space across which an elastic band 20 trained about the prongs 18 and 19 can extend, preferably in its condition that is already initially stretched.

It is also indicated in FIG. 9 that the central region of the upper backrest portion 2 is bent, buckled or arched in the backward direction. This is denoted by respective curved lines, collectively designated by the reference numeral 21, at that region. However, instead of this, a bifurcated zone like that discussed above could be provided at this upper region as well, and a least one elastic belt could be used here, too, to span the distance between the respective prongs of this additional bifurcated zone.

The seat arrangement 1 to 3 is ordinarily complemented into a complete piece of furniture by a support structure that is, however, not shown in the drawing. In principle, this support structure need only support the depicted seating shell that is constituted by the seat 3 proper and the lower backrest portion 1 integral with it in the illustrated embodiments. However, such a piece of furniture could also be supplemented with armrests, as known generally and/or from one or more of the patent documents mentioned above.

In use, when a person sits down on such a piece of furniture, that is on the seat 3, he or she will quite naturally and possibly even unwittingly attempt to push the upper backrest portion 2 with his or her back in the rearward direction, as indicated in FIG. 9 by the reference character A. As a result of this, the extension 4 moves forwardly out of the cut-out 11, to a more significant extent at its lower end than elsewhere, as indicated by the arrow B. This means that either the lower end of the extension 4 (in the construction illustrated in FIG. 1), or the elastic belt 20 come immediately or mediately (through the padding 10*a*, 10*b*) in contact with the lower back of the seat user or occupant. In the final analysis, what results from the construction of the backrest 1, 2 as shown in the drawing and discussed above is an extraordinary feeling of comfort on the part of the occupant. This is achieved by using measures and/or means that are relatively simple, and inexpensive to boot.

While it was mentioned above that the lower region (the extension 4) and the upper region of the upper backrest portion 2 advantageously enclose an obtuse angle with one another, it is also possible and contemplated by the present invention for these two regions to extend along a common plane. In that case, the hinge arrangements 5 of the modified construction of FIG. 8 would be substantially straight like those shown in FIG. 9, not angularly displaced relative to one another about the crease line 16 as they are in FIG. 9 in conformity with the aforementioned obtuse angle existing between the upper and lower regions of the upper backrest portion 2.

At least in theory, it would also be possible to use, instead of the bifurcated configuration of the extension 4 as shown in FIG. 9, a rearwardly buckled configuration of the extension similar to that indicated in FIG. 9 by the curved lines 21 at the upper region of the upper backrest portion 2, without sacrificing any or much of the perception of comfort ensuing from the use of the recess 17 and belt 20 stretching across it.

It will be understood that each of the elements described above, or two or more together, also may find a useful application in other types of constructions differing from the types described above.

While the invention has been illustrated and described as embodied in a backrest for a seat, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A backrest for a seat, comprising, as considered in a position of use thereof:

a) a lower stationary back portion having a pair of side parts with upper edges, and a central cut-out depending from said upper edges between said side parts;

b) an upper movable back portion having a pair of side sections with lower edges, and an integral central extension depending from said lower edges between said side sections; and c) means at and extending across respective interspaces existing between said upper and lower edges at an elevation above said extension for connecting said side sections of said upper back portion and said side parts of said lower back portion with one another for pivoting of said movable upper back portion relative to said stationary lower back portion about a pivot axis extending transversely above said extension from a first position in which said extension is fully received within said cut-out to a second position in which said extension is located substantially entirely outside said cut-out and frontwardly of said lower back portion in a supporting relationship with the lower back of an occupant sitting on the seat.

2. The backrest according to claim 1, wherein said connecting means includes a pair of hinges spaced apart along said pivot axis, said hinges being mounted on said side sections of said upper back portion and said side parts of said lower back portion.

3. The backrest according to claim 2, wherein said upper and lower back portions and said hinges are constructed of a one-piece assembly.

4. The backrest according to claim 1, wherein said upper and lower back portions have respective front surfaces for facing the seated occupant, and wherein said connecting means is mounted flush with said front surfaces.

5. The backrest according to claim 1, wherein said upper and lower back portions have front surfaces for facing the seated occupant, and wherein said connecting means is mounted rearwardly of said front surfaces.

6. The backrest according to claim 1, wherein said upper and lower back portions are formed of a sheet material.

7. The backrest according to claim 1, wherein said extension has an outer shape, and wherein said cut-out has a shape substantially complementary to said outer shape of said extension.

8. The backrest according to claim 1, wherein said upper and lower back portions have front and rear surfaces respectively for facing towards and away from the seated occupant, and wherein said connecting means includes biasing means for constantly urging said upper back portion to said first position thereof relative to said lower back portion.

9. The backrest according to claim 8, wherein said biasing means is an elastic plate, and wherein said connecting means includes means for mounting said elastic plate to said rear surfaces of said upper and lower back portions.

10. The backrest according to claim 8, wherein said biasing means is an elastic plate, and wherein said connecting means includes means for mounting said elastic plate between said front and said rear surfaces of said upper and lower back portions.

11. The backrest according to claim 8, wherein said biasing means is an elastic block cast between said front and the rear surfaces of said upper and lower back portions.

12. The backrest according to claim 1, wherein said upper and lower back portions have front and rear surfaces respectively for facing towards and away from the seated occupant, and wherein said connecting means includes a pair of hinges mounted to said rear surfaces of said upper and lower back portions.

13. The backrest according to claim 1, wherein said upper and lower back portions have front and rear surfaces respectively for facing towards and away from the seated occupant, and wherein said connecting means includes a pair of hinges integrally formed with said rear surfaces of said upper and lower back portions.

14. The backrest according to claim 1, wherein said lower back portion includes an integral seat portion.

15. The backrest according to claim 14; and further comprising padding mounted on said upper and lower back portions and on said seat portion.

16. The backrest according to claim 1, wherein said extension has a bifurcated configuration containing a recess situated between two transversely spaced prongs; and further comprising at least one elastic band trained around said prongs and extending in a stretched condition across said recess between said prongs.

17. The backrest according to claim 16, wherein said cut-out and said extension have transverse widths exceeding one-half the width of said lower back portion.

18. The backrest according to claim 16, wherein said upper back portion is rearwardly buckled at its upper central region.

19. The backrest according to claim 16, wherein said upper back portion has an upper region that is bifurcated as well, including upwardly pointing prongs; and further comprising at least one additional elastic band trained around said upwardly pointing prong and extending in a stretched condition across an additional recess situated between said upwardly pointing prongs.

20. The backrest according to claim 1, wherein said extension and the remainder of said upper back part enclose with one another an angle deviating to a small but significant degree from 180°.

* * * * *